US008752845B2

(12) United States Patent
Elkington

(10) Patent No.: US 8,752,845 B2
(45) Date of Patent: Jun. 17, 2014

(54) SNOWBOARD BINDING

(71) Applicant: Flow Sports, Inc., San Clemente, CA (US)

(72) Inventor: Mark Elkington, Hong Kong (CN)

(73) Assignee: Flow Sports, Inc., San Clemente, CA (US)

( * ) Notice: Subject to any disclaimer, the term of this patent is extended or adjusted under 35 U.S.C. 154(b) by 0 days.

(21) Appl. No.: 14/042,538

(22) Filed: Sep. 30, 2013

(65) Prior Publication Data

US 2014/0042719 A1 Feb. 13, 2014

Related U.S. Application Data

(63) Continuation of application No. 13/461,629, filed on May 1, 2012, now Pat. No. 8,544,870, which is a continuation of application No. 11/956,197, filed on Dec. 13, 2007, now Pat. No. 8,172,252, which is a continuation of application No. 11/411,709, filed on Apr. 25, 2006, now Pat. No. 7,367,579, which is a continuation of application No. 10/772,002, filed on Feb. 4, 2004, now Pat. No. 7,232,132.

(30) Foreign Application Priority Data

Feb. 11, 2003 (DE) ..... 103 05 764

(51) Int. Cl.
*A63C 9/22* (2012.01)

(52) U.S. Cl.
USPC ..... 280/14.24; 280/634

(58) Field of Classification Search
USPC ..... 280/14.24, 634
See application file for complete search history.

(56) References Cited

U.S. PATENT DOCUMENTS

| | | | | | |
|---|---|---|---|---|---|
| 3,950,001 | A | * | 4/1976 | Weigl | 280/618 |
| 3,975,034 | A | * | 8/1976 | Weigl et al. | 280/618 |
| 4,264,088 | A | | 4/1981 | Replogle | |
| 4,353,574 | A | | 10/1982 | Faulin | |
| 5,261,689 | A | * | 11/1993 | Carpenter et al. | 280/618 |
| 5,356,170 | A | * | 10/1994 | Carpenter et al. | 280/618 |

(Continued)

FOREIGN PATENT DOCUMENTS

| | | | |
|---|---|---|---|
| DE | 10305764 | A1 | 8/2004 |
| EP | 793920 | A1 | 9/1997 |

(Continued)

OTHER PUBLICATIONS

Derwent abstract citing European patent, EP 1447117 published Aug. 18, 2004, for "Snowboard Binding".

(Continued)

*Primary Examiner* — Jeffrey J Restifo
(74) *Attorney, Agent, or Firm* — Fred C. Hernandez; Mintz Levin Cohn Ferris Glovsky and Popeo, P.C.

(57) ABSTRACT

A snowboard binding includes a base plate and a heel support attached directly or indirectly to this base plate so that it can pivot. Intermediate elements mount the heel support and can be adjusted in the longitudinal direction of the snowboard binding. Thus, the effective length of the snowboard binding can be adapted to the respective boot. Also, through different positioning of the intermediate elements, the heel support can be arranged diagonally relative to the longitudinal axis of the snowboard binding.

9 Claims, 4 Drawing Sheets

(56) References Cited

U.S. PATENT DOCUMENTS

| | | | | |
|---|---|---|---|---|
| 5,556,123 | A * | 9/1996 | Fournier | 280/607 |
| 5,692,765 | A * | 12/1997 | Laughlin | 280/619 |
| 5,771,609 | A * | 6/1998 | Messmer | 36/89 |
| 5,893,576 | A | 4/1999 | Hauglin | |
| 5,918,897 | A * | 7/1999 | Hansen et al. | 280/611 |
| 5,997,027 | A * | 12/1999 | Jungkind | 280/617 |
| 6,003,893 | A * | 12/1999 | Hansen | 280/624 |
| 6,007,077 | A * | 12/1999 | Moe | 280/14.22 |
| 6,027,136 | A * | 2/2000 | Phillips | 280/618 |
| 6,032,974 | A * | 3/2000 | Saillet | 280/611 |
| 6,065,770 | A * | 5/2000 | Hansen et al. | 280/617 |
| 6,116,634 | A * | 9/2000 | Mometti | 280/613 |
| 6,155,578 | A | 12/2000 | Patterson | |
| 6,234,514 | B1 | 5/2001 | Dubuque | |
| 6,267,403 | B1 | 7/2001 | Bossin et al. | |
| 6,283,482 | B1 * | 9/2001 | Coulter | 280/14.22 |
| 6,364,323 | B1 | 4/2002 | Coulter | |
| 6,581,944 | B1 * | 6/2003 | Marmonier et al. | 280/14.22 |
| 6,672,610 | B2 * | 1/2004 | Freisinger et al. | 280/623 |
| 6,886,849 | B2 * | 5/2005 | Mandon | 280/618 |
| 6,910,706 | B2 | 6/2005 | Holzer et al. | |
| 6,938,913 | B2 | 9/2005 | Elkington | |
| 7,207,592 | B2 * | 4/2007 | Pascal et al. | 280/623 |
| 7,232,132 | B2 * | 6/2007 | Elkington | 280/11.32 |
| 7,232,147 | B2 * | 6/2007 | Couderc | 280/623 |
| 7,246,811 | B2 * | 7/2007 | Martin | 280/611 |
| 7,316,412 | B2 * | 1/2008 | Couderc | 280/617 |
| 7,367,579 | B2 * | 5/2008 | Elkington | 280/611 |
| 7,494,148 | B2 * | 2/2009 | Muscatelli | 280/611 |
| 7,503,579 | B2 * | 3/2009 | Couderc | 280/623 |
| 7,568,719 | B2 * | 8/2009 | Sauter | 280/619 |
| 8,128,117 | B2 * | 3/2012 | Neiley et al. | 280/618 |
| 8,172,252 | B2 * | 5/2012 | Elkington | 280/634 |
| 2001/0015543 | A1 | 8/2001 | Joubert Des Ouches | |
| 2003/0094790 | A1 * | 5/2003 | Poscich | 280/618 |
| 2003/0146600 | A1 * | 8/2003 | Holzer | 280/618 |
| 2004/0169350 | A1 * | 9/2004 | Elkington | 280/623 |
| 2004/0227327 | A1 | 11/2004 | Elkington et al. | |
| 2005/0046150 | A1 * | 3/2005 | Couderc | 280/623 |
| 2005/0082790 | A1 * | 4/2005 | Dean et al. | 280/623 |
| 2005/0104330 | A1 * | 5/2005 | Sauter | 280/619 |
| 2005/0167933 | A1 * | 8/2005 | Couderc | 280/14.24 |
| 2006/0237920 | A1 * | 10/2006 | Steere | 280/11.36 |
| 2006/0244241 | A1 * | 11/2006 | Martin | 280/619 |
| 2007/0013166 | A1 * | 1/2007 | Elkington | 280/620 |
| 2007/0182130 | A1 * | 8/2007 | Laser | 280/619 |
| 2007/0187928 | A1 * | 8/2007 | Muscatelli | 280/620 |

FOREIGN PATENT DOCUMENTS

| | | |
|---|---|---|
| EP | 0838248 A1 | 4/1998 |
| EP | 1186328 A2 | 3/2002 |
| EP | 1447117 A1 | 8/2004 |

OTHER PUBLICATIONS

Derwent citing European patent, EP 0793920 published Sep. 10, 1997, for "Insert for snowboard boot".

Derwent citing European patent, EP0838248 published Apr. 29, 1998, for "Holding device for a boot on a snowboard".

* cited by examiner

SNOWBOARD BINDING

This application is a continuation (and claims the benefit of priority under 35 USC §120) of co-pending U.S. patent application Ser. No. 13/461,629, filed May 1, 2012, titled, "Snowboard Binding," which in turn is a continuation of U.S. patent application Ser. No. 11/956,197, filed Dec. 13, 2007, titled "Snowboard Binding" by Elkington, now U.S. Pat. No. 8,172,252, which is a continuation of U.S. patent application Ser. No. 11/411,709, filed Apr. 25, 2006, titled "Snowboard Binding" by Elkington, now U.S. Pat. No. 7,367,579, which is a continuation of U.S. patent application Ser. No. 10/772,002, filed Feb. 4, 2004, titled "Snowboard Binding" by Elkington, now U.S. Pat. No. 7,232,132, which claims priority to German Patent Application No. DE10305764, filed Feb. 11, 2003, titled "Snowboard Binding" by Elkington, the full disclosures of which are incorporated herein by reference.

BACKGROUND

The invention relates to a snowboard binding.

One such binding is known from EP 0 838 248 B1. This binding has a base plate, which can be mounted on the top side of a snowboard. Side plates project vertically upwards on both sides from the base plate. Adjustable toe and instep straps are attached to these side plates, as well as a heel support, which can pivot and which is generally also called a "highback." The heel support consists of two parts, namely a lower part that can pivot and an upper part screwed onto this lower part, wherein the upper part can be adjusted in position by means of elongated holes. The mentioned toe and instep straps can be adjusted in length in order to adapt the binding to the particular shoe. Also, these straps can be opened for stepping into or out of the binding.

Typically, such bindings are manufactured in only one or a few sizes, wherein it is then up to the user to adapt the binding to his shoe size by adjusting the mentioned straps. The relative position of the heel support to the edge of the snowboard is usually fixed, namely by threaded inserts (so-called inserts) in the snowboard and corresponding holes in a holding plate, which is inserted into an opening of the base plate. According to the bindings found on the market, the holding plate has either an elongated hole or a series of holes for each attachment screw, wherein the position of the binding relative to the snowboard can be adjusted and thus also the relative position between the heel support and the adjacent edge of the snowboard. However, this adjustment is tedious and is usually performed only once during the first assembly of the binding.

SUMMARY

It is an object to improve the known snowboard binding such that the binding can be adapted individually to the respective boot even after the assembly of the base plate on a snowboard and especially such that the position of the heel support is adjustable.

In one aspect, the device disclosed here features a device for retaining a foot or boot on a sports apparatus, the device having a base plate extending lengthwise from a rear end to a front end and widthwise from a first side to a second side. The device also has a heel support element and a pivot mechanism mounting the heel support element to pivot with respect to the base plate, the pivot mechanism having a first pivot support and a second pivot support. The device also has an elongated element extending between the base plate and the heel support element to limit rearward pivot movement of the heel support element relative to the base plate, the elongated element has a first portion and a second portion, the first and second portions of the elongated element being connected to the base by a first and a second lower connection, respectively. The first and second lower connections are located in front of the first and second pivot supports. The device also has an adjustment mechanism to enable a modification of a longitudinal position of the heel support element with respect to the base plate.

In another aspect, the device disclosed here features a device for retaining a foot or boot on a sports apparatus, the device having a base plate extending lengthwise from a rear end to a front end and widthwise from a first side to a second side. The device also has a heel support element and a pivot mechanism mounting the heel support element to pivot with respect to the base plate, and the pivot mechanism having a first pivot support and a second pivot support, said first and second pivot supports being widthwise spaced apart. The device also has an elongated element extending from the heel support element to widthwise spaced-apart positions adjustably fixed longitudinally relative to the base plate, forward of respective ones of said first and second pivot supports, to limit rearward pivot movement of the heel support element relative to the base plate. The device also has an adjustment mechanism to enable a longitudinal positional adjustment of the heel support element with respect to the base plate.

In the following, the embodiments are explained in more detail in connection with the drawings. Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
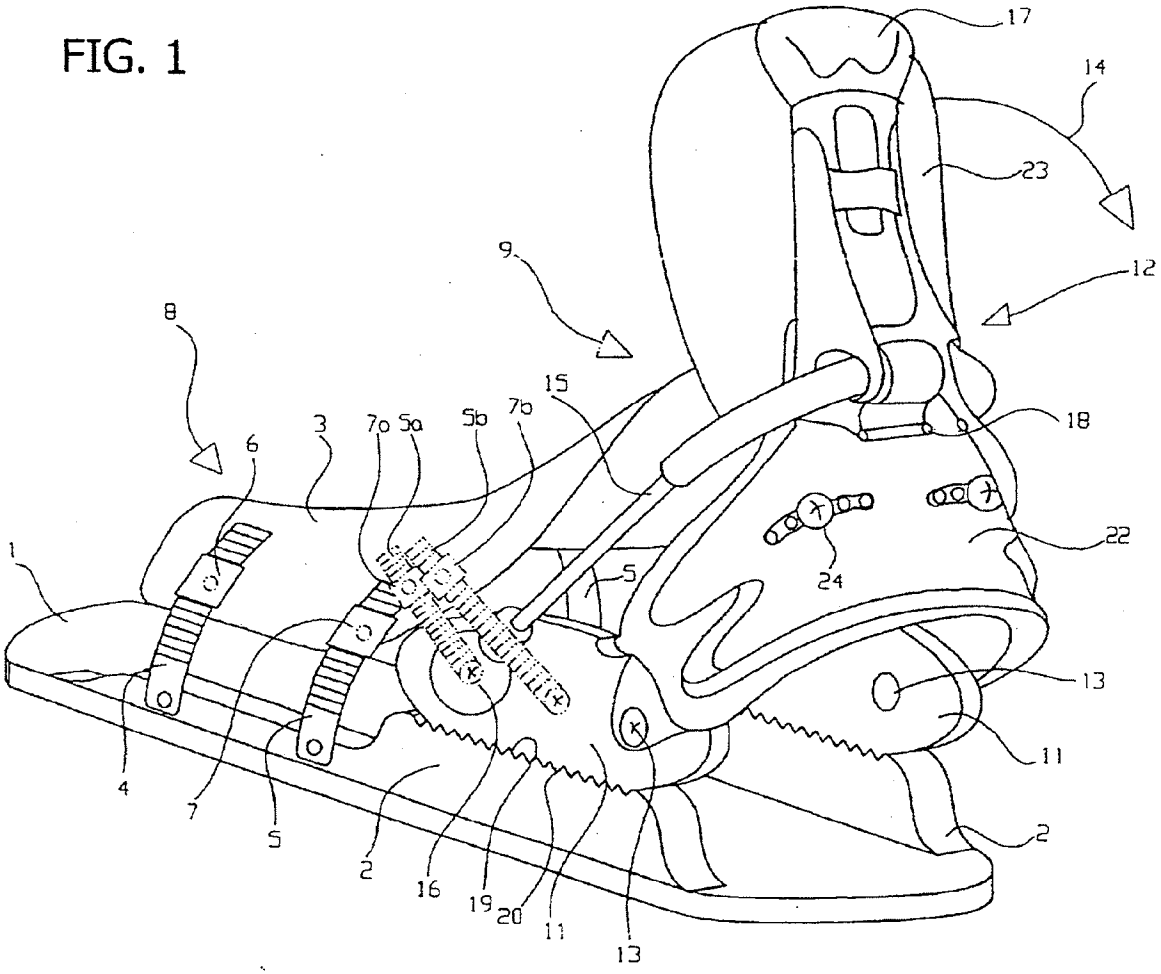
FIG. 1 is a perspective view of a snowboard binding according to an embodiment viewed diagonally from behind.

The snowboard binding of FIG. 1 has a flat base plate 1, from which on both sides side plates 2 project upwards essentially vertically. In the front foot region, there is an instep strap 3, which is attached to the side plates on both sides by means of toothed straps 4 and 5. Locking devices 6 and 7 are attached to the instep strap. The toothed straps 4 and 5 are threaded into these locking devices and can be fixed in place, wherein the length and thus also the height of the instep strap 3 is adjustable. The instep strap 3 is here formed as one piece and extends essentially from the front foot region 8 to the instep region 9 of the not shown shoe.

In the heel region, an intermediate element 11 is attached to both side plates 2. A heel support 12, which can pivot about a pivot support 13, is mounted on this intermediate element, such that the heel support 12 for opening the binding can be pivoted backwards in the direction of the arrow 14. The heel support 12 is held by a tensioning element 15 in the shown closed position, wherein the tensioning element 15 is attached to both intermediate elements 11 and surrounds the heel support 12 on its outer side. Attachment points 16 for the tensioning element 15 can be formed as a pivot support and can be offset forwards in the direction towards the front foot region 8 relative to the pivot support 13. The tensioning element 15 is held on the heel support 12 at a control lever 17, which can pivot about a pivot axis 18. If the control lever 17 is pivoted downwards in the direction towards the base plate 1, then the heel support 12 can be pivoted backwards into the open position. Conversely, the binding is closed by tilting the heel support forwards and tilting the control lever 17 upwards.

As can be seen from FIG. 1, the toothed belt 5 can also be attached to the corresponding intermediate element 11 either, as shown with the reference number 5*a*, to the attachment point 16 for the tensioning element 15 or to a different position of the intermediate element 11, e.g., between the attachment point 16 and the pivot support 13, as made clear with the reference number 5*b*. The associated locking device 7, 7*a*, or 7*b* is always mounted on the instep strap 3 so that it can pivot and so that it can be aligned correctly relative to the toothed strap 5, 5*a*, 5*b*. Obviously, the front toothed strap 4 and its locking device 6 are also fixed to the side plate 2 or to the instep strap 3 so that they can pivot, such that the instep strap 3 is also pushed forwards and backwards in the longitudinal direction of the binding. In this way, the instep strap can be positioned.

The intermediate elements 11 have on their lower side a toothed section 19, which engages a counter toothed section 20 on the side plates 2. The intermediate elements 11 can be displaced in the longitudinal direction of the binding, wherein the position of the heel element 12 can be adjusted relative to the longitudinal axis of the binding. Thus, the effective length of the binding can be adapted to the respective shoe.

The two intermediate elements 11 can be adjusted independently from each other, wherein the heel support 12 can also be positioned diagonally.

In one embodiment, the heel support 12 consists of two parts, namely a lower part 22, which is attached to the intermediate elements 11 and an upper part 23, which is attached to the lower part, by means of a threaded connection 24, which permits various relative positions between the upper and lower part 23 and 22 through a series of holes 25 or an elongated hole, wherein likewise a diagonal position of the upper part 23 is possible relative to the longitudinal axis 21.

Figure 2:
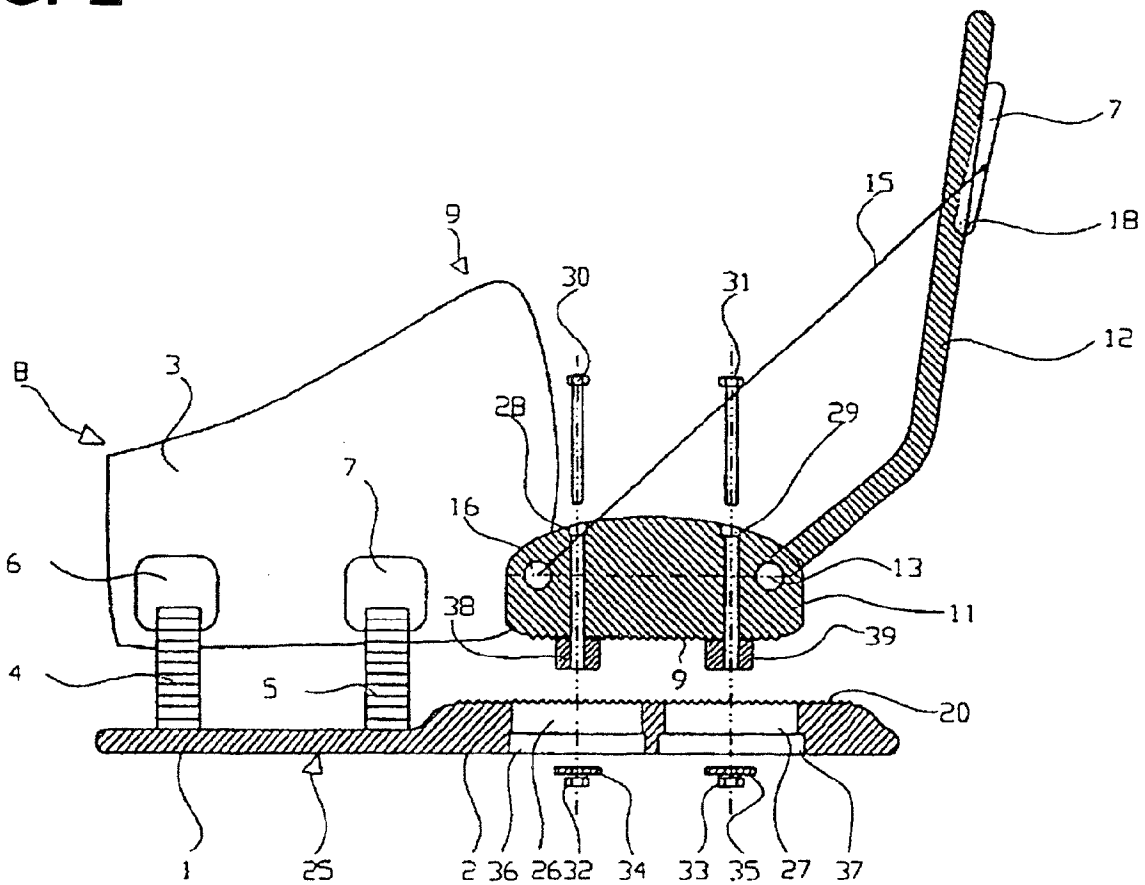
FIG. 2 is a side view of the binding in partially cut-away representation.

The attachment of the intermediate elements 11 to the side plates 2 can be seen in more detail in FIG. 2. The side plates here each have two longitudinal holes 26 and 27, which extend to the floor 25 of the base plate 1 and which extend in the longitudinal direction of the binding. The toothed section 20 is formed all around the longitudinal holes 26 and 27.

The intermediate elements 11 have two through-holes 28 and 29, which extend through the entire height of the intermediate elements 11. Screws 30 and 31 can be inserted into these holes 28 and 29, which screws interact with threaded nuts 32 and 33, and also, if necessary, plain washers or locking washers 34 and 35, which are to be attached outwards from the floor 25 of the base plate 1. The longitudinal holes 26 and 27 have an expanded section 36, 37 outwards from the floor 25, so that the nuts 32 and 33 and the plain washers 34 and 35 can be received in these expanded sections and do not project beyond the floor 25 of the base plate 1.

For better retention of the intermediate elements 11 on the side plates 2, support elements 38 and 39, which engage flush in the longitudinal holes 26 and 27, respectively, and which are supported on their side walls, surround the screws 30 and 31. The support elements 38 and 39 can be formed as separate parts and can have a toothed section corresponding to the toothed section 19 on their side pointing towards the intermediate element 11. However, they can also be formed as one piece on the intermediate elements 11.

Figure 3:
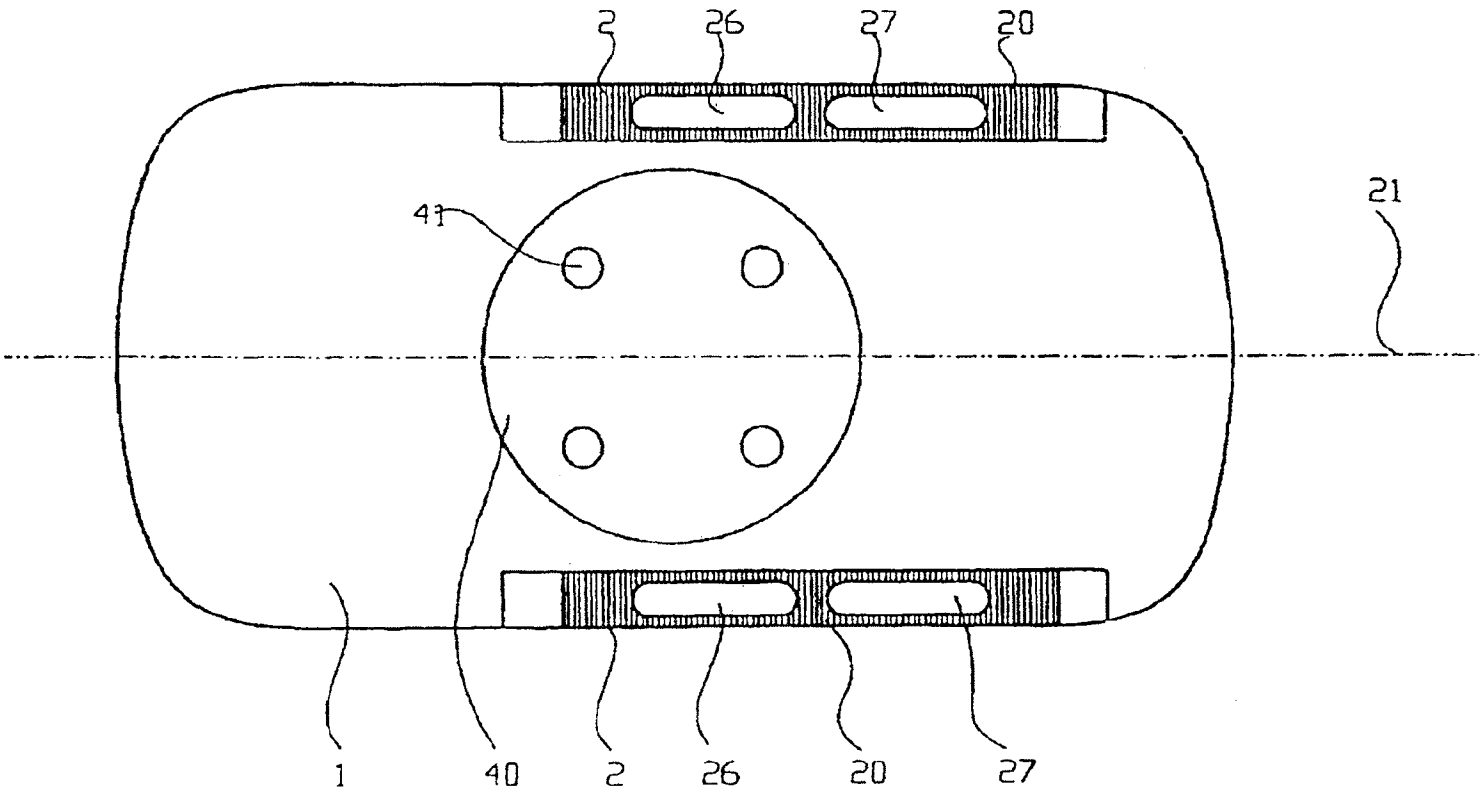
FIG. 3 is a top view of the base plate.

FIG. 3 shows a top view of the base plate 1 with the side plates 2. The position and arrangement of the longitudinal holes 26 and 27, as well as the toothed section 20, can be seen clearly in this figure. In a known way, the base plate is attached to the snowboard by means of an attachment plate 40, which engages in an opening in the base plate, by means of screws, which engage in threaded holes 41. By means of this attachment plate, which is also called a "rotating plate," the rotational position of the binding, i.e., the alignment of the longitudinal axis 21 of the binding relative to the longitudinal axis of the not shown snowboard, can be adjusted.

Figure 4:
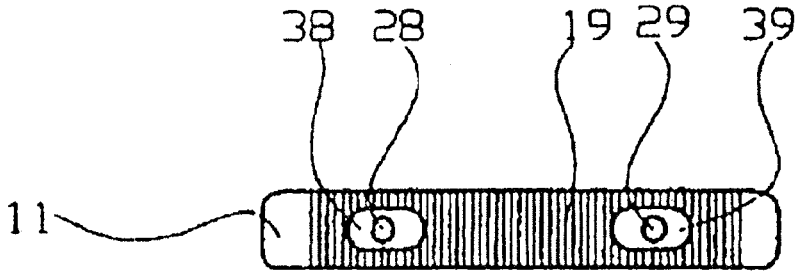
FIG. 4 is a view of the bottom side of an intermediate element.

FIG. 4 shows a view of the bottom side of an intermediate element 11 with the support elements 38 and 39, as well as the holes 28 and 29.

Finally, it should be mentioned that the device is usable not only for snowboard bindings of the illustrated type, for which the heel element 12 is pivoted backwards to open the binding. It can also be used similarly for snowboard bindings, for which the heel element can be pivoted only forwards and the binding is opened by releasing the instep and toe straps.

When introducing elements of the present device or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the device are achieved and other advantageous results attained.

As various changes could be made in the above products and methods without departing from the scope of the embodiments, it is intended that all matter contained in the above description and shown in the accompanying drawings shall be interpreted as illustrative and not in a limiting sense.

What is claimed:

1. A device for retaining a foot or boot on a sports apparatus, the device comprising:

a base plate extending lengthwise from a rear end to a front end and widthwise from a first side to a second side;

a heel support element and a pivot mechanism mounting the heel support element to pivot with respect to the base plate, the pivot mechanism comprising a first pivot support and a second pivot support;

an elongated element extending between the base plate and an attachment location on the heel support element to limit rearward pivot movement of the heel support element relative to the base plate, the elongated element having a first portion and a second portion, the first and second portions of the elongated element being connected to the base plate by a first and a second lower connection, respectively, the first and second lower connections being located in front of the first and second pivot supports; and at least one intermediate element, each intermediate element:

mounted below the heel support element;

mounted above a side plate that is connected to one side of the base plate;

having, on a lower side, an interacting section that engages with a counter section on the side plate; and adjustable in its location relative to the rear and front ends of the base plate;

wherein the attachment location, first pivot support, and first lower connection collectively define a generally triangular shape when viewed from a side of the device when the heel support element is in a closed position around a user's heel.

2. The device according to claim 1, wherein:

the at least one intermediate element enables a predeterminate longitudinal displacement of the heel support element independent of the elongated element.

3. The device according to claim 1, further comprising:

a mechanism to enable a predeterminate displacement of the heel support element simultaneously with the elongated element.

4. The device according to claim 1, wherein:

the device is a snowboard binding for retaining a snowboard boot on a snowboard.

5. The device according to claim 1, further comprising:

an assembly to mount the base plate to the sports apparatus.

6. The device according to claim 5, wherein:

the base plate comprises a through opening in a thickness of the base plate;

the assembly to mount the base plate to the sports apparatus comprises a disk adapted to be positioned within and to be engaged with a periphery of the opening of the base plate, and a plurality of screws adapted to extend through holes in the disk and into the sports apparatus.

7. The device according to claim 1, wherein:

the at least one intermediate element enables a predetermined longitudinal displacement of the heel support element parallel to an upper support surface of the base plate.

8. A device for retaining a foot or boot on a sports apparatus, the device comprising:

a base plate extending lengthwise from a rear end to a front end and widthwise from a first side to a second side;

a heel support element and a pivot mechanism mounting the heel support element to pivot with respect to the base plate, the pivot mechanism comprising a first pivot support and a second pivot support, said first and second pivot supports being widthwise spaced apart;

an elongated element extending from the heel support element to widthwise spaced-apart positions adjustably fixed longitudinally relative to the base plate, forward of respective ones of said first and second pivot supports, to limit rearward pivot movement of the heel support element relative to the base plate; and at least one intermediate element, each intermediate element:

mounted below the heel support element;

mounted above a side plate that is connected to one side of the base plate; and adjustable in its location relative to the rear and front ends of the base plate.

9. The device according to claim 1, wherein the interacting section on each intermediate element and the counter section on the side plate are toothed sections.

* * * * *